United States Patent [19]

Ginsberg

[11] Patent Number: 4,907,352

[45] Date of Patent: Mar. 13, 1990

[54] SHOE LACE REPLACING AND SHOE FASTENING DEVICE

[76] Inventor: Jay Ginsberg, 525 N. Kings Rd., #6, Los Angeles, Calif. 90048

[21] Appl. No.: 256,709

[22] Filed: Oct. 12, 1988

Related U.S. Application Data

[63] Continuation-in-part of Ser. No. 151,448, Feb. 2, 1988, abandoned.

[51] Int. Cl.[4] ..... A43C 11/00; A43C 11/12

[52] U.S. Cl. ..... 36/50; 2/DIG. 6; 12/113; 24/306

[58] Field of Search ..... 36/50, 132; 12/113; 2/245, DIG. 6, 442; 24/306, 727, 140, 143 B

[56] References Cited

U.S. PATENT DOCUMENTS

| | | | |
|---|---|---|---|
| 677,539 | 7/1901 | Donovan | 12/113 |
| 729,300 | 5/1903 | Ellis | 12/113 |
| 808,028 | 12/1905 | Ellis | 12/113 |
| 1,491,258 | 4/1924 | Gluckin | 2/245 X |
| 3,137,952 | 6/1964 | Shears | 36/50 |
| 3,205,544 | 9/1965 | Streule et al. | 36/50 X |
| 3,902,229 | 9/1975 | Doerpinghaus | 24/306 |
| 4,777,705 | 10/1988 | Ingram | 24/140 X |

FOREIGN PATENT DOCUMENTS

| | | | |
|---|---|---|---|
| 430494 | 8/1967 | Switzerland | 36/50 |

*Primary Examiner*—James Kee Chi

*Attorney, Agent, or Firm*—Poms, Smith, Lande & Rose

[57] ABSTRACT

A shoe lace replacing and shoe fastening device comprising a pair of eyelet members, each member having a pair of spaced fasteners for securing one eyelet member to adjacent eyelets along one side of a shoe upper, after removal of the laces thereof, and for securing the other eyelet member to adjacent eyelets along the other side of a shoe upper. An elongated strip of Velcro material is secured to the eyelet members and adapted to extend removably secure to itself whereby the shoe can be fastened without conventional laces.

4 Claims, 2 Drawing Sheets

SHOE LACE REPLACING AND SHOE FASTENING DEVICE

RELATION TO PENDING APPLICATIONS

This application is a continuation-in-part of pending application Ser. No. 07/151,448 filed Feb. 2, 1988 now abandoned.

BACKGROUND OF THE INVENTION

1. Field of the Invention

The inventions relates to shoe lace substitution devices; and, more particularly, to a device for replacing conventional shoe laces and for fastening such shoes.

2. Description of the Prior Art

Velcro fasteners used to fasten shoes are well known in the art. Such shoes are limited in type, the sneaker variety being quite popular. Also, children's shoes have such fasteners since children have difficulty in both tieing laced shoes and keeping them securely tied.

Handicapped people and people with arthritis also have trouble tieing conventional shoe laces. A shoe using Velcro material as closure means is disclosed in U.S. Pat. No. 4,270,285 to Antonious. However, this apparatus is a fixed part of the shoe and quite expensive. In U.S. Pat. No. 4,210,983 to Green, an eyelet clamp for shoes is disclosed which replaces conventional laces and is mounted to the shoe eyelets. However, no easy fastening means is provided. A snap-in shoe lace is disclosed in U.S. Pat. No. 3,947,928 to Maldonado. However, the snaps of the laces must be snapped together to secure the same and do not provide variable adjustment. Blum, in U.S. Pat. No. 4,553,293, describes a device attachable to pre-existing shoe laces using Velcro material. The device must be laced into the shoe laces and does not provide variable adjustment.

In U.S. Pat. No. 3,205,544 to Streule et al, a closing device for shoes is disclosed using Velcro strips. This device has wire elements in the FIG. 1 embodiment insertible into shoe eyelets which elements can be easily pulled out. In the FIG. 11 embodiment, the strip of material is secured to the wire elements (see FIG. 12) and cannot be easily replaced. That is, one may desire to change the strip to vary the color, change a name on the strip, etc. This cannot be carried out by Streule et al. In U.S. Pat. No. 729,300 to Ellis, a fastener for shoes is disclosed having a strip of securing material again firmly secured to the fastening element and not easily replaced.

There thus exists a need for a device which can replace pre-existing shoe laces in conventional shoes and which is variably adjustable, easily securable and can be interchanged quickly and easily to fasten the shoe to the feet of the wearer.

SUMMARY OF THE INVENTION

It is an object of this invention to provide a device for replacing conventional shoe laces yet permitting fastening of such shoes.

It is a further object of this invention to provide such device which can be used in the conventional eyelets of ordinary laced shoes.

These and other objects are preferably accomplished by providing a shoe lace replacing and shoe fastening device comprising a pair of eyelet members, each member having a pair of spaced fasteners for securing one eyelet member to adjacent eyelets along one side of a shoe upper, after removal of the laces thereof, and for securing the other eyelet member to adjacent eyelets along the other side of a shoe upper. An elongated strip of Velcro material is secured the eyelet members and adapted to extend and removably secure to itself whereby the shoe can be fastened without conventional laces.

BRIEF DESCRIPTION OF THE PREFERRED EMBODIMENT

Figure 1:
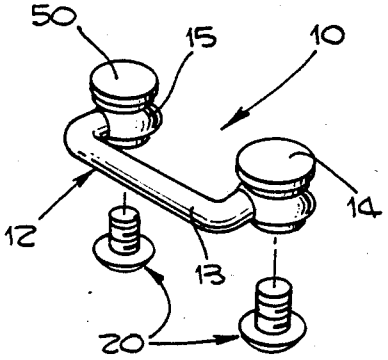
FIG. 1 is a perspective view of one part of the device of the invention.
Figure 6:
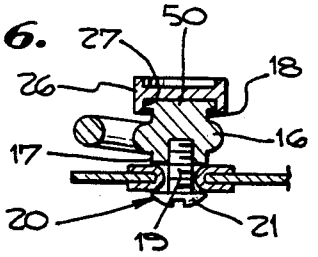
FIG. 6 is a view taken long lines VI—VI of FIG. 5.

Referring now to FIG. 1 of the drawing, a shoe fastening and shoe lace replacing device 10 is shown having an elongated strip 11 (FIG. 2) of a Velcro material, such as of hook type Velcro material. A U-shaped eyelet member 12 is also provided having a bail portion 13 terminating at each end in spaced apertured bosses 14, 15 (see also FIGS. 3 and 6). Each boss 14, 15 includes a main central portion 16, a lower portion 17 of lesser diameter than portion 16, and an upper portion 18, similar to portion 17, which may be slightly lesser in diameter than portion 16, and an upper circular portion 50 greater in diameter than portion 18. Portions 16–18 and 50 may be one piece, as seen in FIG. 6. Portion 17 has a central threaded hole receiving therein the threaded shaft 19 of a screw 20 having a hex head 21. Of course, head 21 may be of the slotted type or any other suitable type head.

Figure 2:
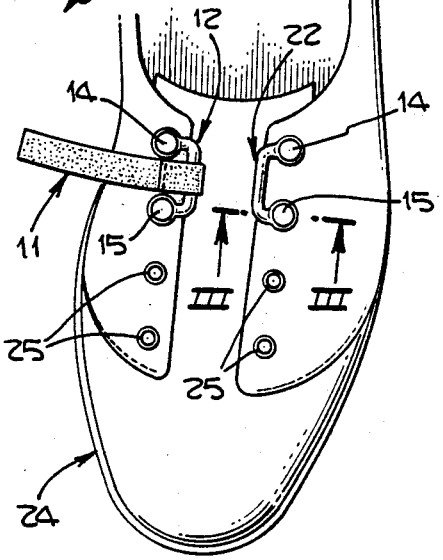
FIG. 2 is a top plan view of a pair of the parts of FIG. 1 applied to a shoe showing the first step in installing the same.
Figure 3:
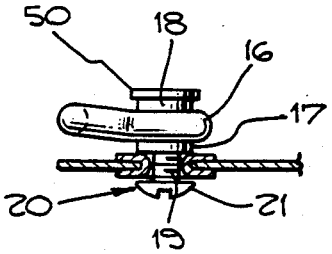
FIG. 3 is a view taken along lines III—III of FIG. 2.

As seen in FIG. 2, device 10 includes a second U-shaped eyelet member 22 identical to member 12 so that like numerals refer to like parts of member 12. However, strip 11 has a loop portion (FIG. 2) which encircles the bail portion 13 of member 12 and thus is secured thereto.

As seen in FIG. 2, a conventional normally laced shoe 24 is shown having a plurality of spaced eyelets 25 from which the conventional laces of the shoe 24 have been removed. Eyelet member 22 is secured to two adjacent eyelets on one side of the upper of shoe 24 by inserting the shaft 19 of screws 20 (FIGS. 3 and 6) through adjacent eyelets and into the threaded portion 17 of each boss 14, 15. Eyelet member 12 is secured to two adjacent eyelets on the other side of shoe 24 in like manner, the strip 11 extending across to the eyelet member 22 and under the bail portion 13 thereof (FIG. 4) where it can be pulled back on itself to detachably secure eyelet member 12 to eyelet member 22 by engagement of mating portions of the Velcro material of strip 11 as seen in FIG. 5.

Figure 4:
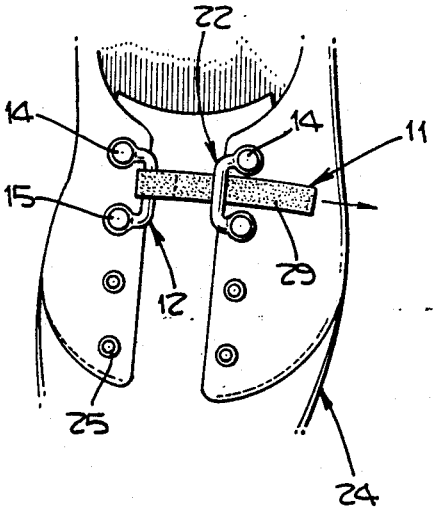
FIG. 4 is a top plan view of a shoe having the device of the invention installed thereon showing a second step in the installation thereon.
Figure 5:
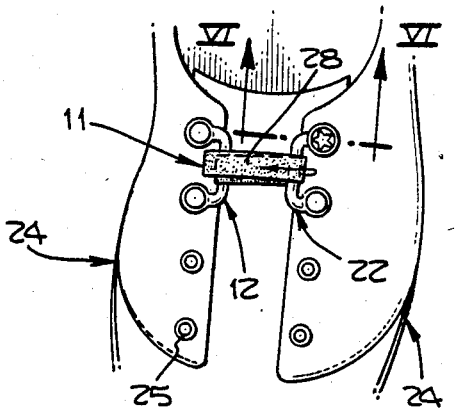
FIG. 5 is the final step in securing device 10 to the shoe of FIGS. 2 and 4.

The screws 20 can be inserted through the eyelets 25 from either the underside thereof, as seen in FIGS. 2, 4 and 5, so that portions 18 are uppermost, or from the top. However, as seen in FIG. 6, decorative items, such as a star 26 (see also FIG. 5) having a central cavity 27, may be provided. Cavity 27 is configured and of a size to snap fit onto portion 50, as seen in FIGS. 5 and 6, to provide a decorative aspect. Of course, various designs can be used.

Figure 7:
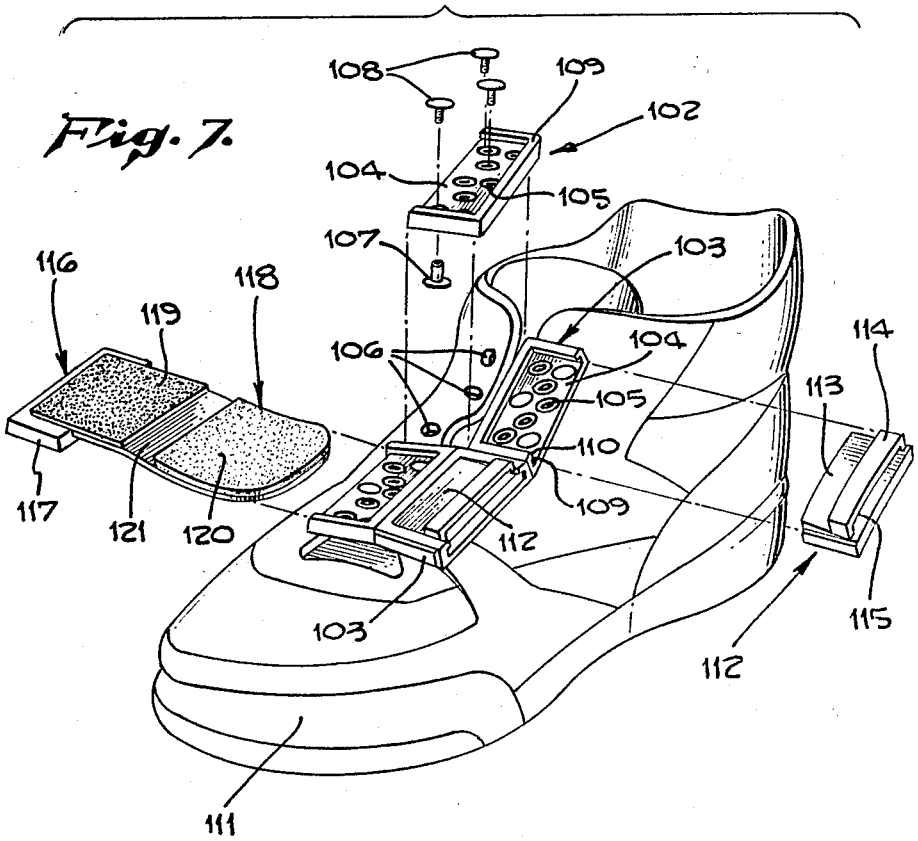
FIG. 7 is an exploded view of a conventional shoe having a modified device installed on a shoe.
Figure 8:
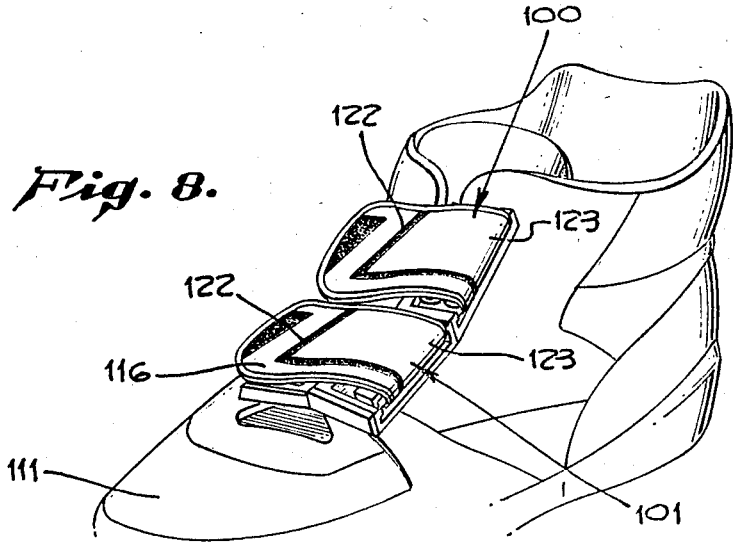
FIG. 8 is a perspective view of the shoe and device of FIG. 7 shown installed thereon.

Referring now to FIGS. 7 and 8 wherein like numerals refer to like parts of the embodiment of FIGS. 1 to 6, another variation of the shoe lace replacing and shoe fastening device is disclosed. As seen in FIGS. 7 and 8, a pair of such devices 100, 101 are shown, each being identical to the other. As seen in FIG. 7, each device 100 includes a pair of eyelet member 102, 103. Each eyelet member 102, 103 includes a generally flat base portion 104 having a plurality of spaced holes 105 therethrough. These holes 105 are adapted to be aligned with the pre-existing spaced holes 106 on the upper of shoe 111 as seen in FIG. 7. Thus, conventional laces (not shown) have been removed from the holes 106 and holes 105 are staggered and/or otherwise oriented on base portion 104 to align with holes 106. Thus, base portion 104 is sure to be aligned with two or more pre-existing holes, such as holes 106, on any shoe due to the spacing, number and staggering of holes 105. Any suitable means, such as aforementioned screws 20 or slotless flat headed screws 108 may be used which extend through holes 106 and thread to internally threaded flat headed fasteners 107 (FIG. 7). Obviously, one such screw 108 and fastener 107 may be associated with each hole 106.

Each base portion 104 is circumscribed on the upper surface by a U-shaped peripheral wall 109 having an inwardly extending flange 110 forming a slotted opening along one side thereof (one of the elongated sides as seen in FIG. 7). As is also seen in FIG. 7, the eyelet members 102, 103 are assembled to shoe 111 so that the slotted openings thereon open outwardly on opposite sides of shoe 111. An insert member 112 is provided having a flat base plate 113 and a U-shaped member 114 on the upper rear surface thereof forming a space 115 between member 114 and the upper surface of base plate 113. It is to be understood that the width of base plate 113 and thickness thereof is related to the spacing between the side walls of the slotted opening in eyelet member 103 and the spacing between the upper wall of base member 104 and flange 110 so that an insert member 112 is insertible into the slotted opening of eyelet member 103 as seen in the lower assembled eyelet member 103 and insert member 112 of FIG. 7.

A second insert member 116 is provided also having a base member 117 having a width and thickness related to the spacing of eyelet member 102 between the upper wall of base member 104 and flange 110 so that insert member 116 is insertible into the slotted opening of eyelet member 102 as seen in the lower assembled eyelet member 102 and insert member 116 in FIG. 8. Of course, the shorter dimension of each insert member 112, 116 may be related to the shorter dimension of each base member 102, 103 so that the insert members fit neatly and snugly in position, the peripheral walls of the base members acting as stops.

As seen in FIG. 7, an elongated strip 118 of a Velcro material is secured at one end to the upper surface of base member 117. Strip 118 has a loop portion 119 and a hook portion 120 separated by a flexible midportion 121. When insert members 112 and 116 are assembled to eyelet members 102, 103 as heretofore discussed, the hook portion 120 of strip 118 is insertible under U-shaped member 114 as seen in FIG. 8 and folded at portion 121 back on itself with hook portion 120 engaging loop portion 119 as seen in FIG. 8.

Of course, as previously discussed, the hook portion can be portion 119 and the loop portion can be portion 120. Also, as seen in FIG. 8, a design or other decorative or identifying indicia 122 can be provided on the smooth underside 123 of strip 118 to add color or name identity to the shoe 111. Thus, such strips 118, already attached to base members 116, can be quickly and easily interchanged to vary the design, color, effect, etc.

Also, although two assemblies 100, 101 have been disclosed, obviously only one may be used.

Any suitable materials may be used. The Velcro materials may be used. The Velcro material of strips 11, 118 may be on some or all parts thereof, on one or both sides, and may be made of hook and loop material, or only hook material which hooks back on itself, the other side, as side 28 in FIG. 1, and the side 123 being smooth. In the FIG. 3 embodiment the side 29 in FIG. 3 may be of hook material.

Strips 11 and 118 may be of elastic material, if desired. The spacing between bosses 14, 15 and holes 105 are chosen to be comparable to the spacing between conventional eyelets. Of course, eyelet members 12, 22, 102, 103 and insert members 112, 116 may be of any suitable material, such as metal, plastic, hard rubber, etc. For example, a bendable material such as stiff rubber may be used to compensate for variations in eyelet spacing. The strips 11 and 118 may be of different colors and decorated, if desired. The threaded shafts of the screws are chosen to be of a diameter to be easily insertible in conventional eyelets.

It can be seen that there is disclosed a device for replacing existing laces on conventional shoes, then used to fasten the shoes using the conventional eyelets of the shoes. Such a device enables one who has difficulty in tying shoes laces, such as a young child, a handicapped person, etc., to secure the same quickly and easily. Conventional laced shoes can be quickly converted to the device of this invention. The design of the strips can be quickly and easily changed. Other variations may of course occur to an artisan and the scope of the invention is to be determined by the appended claims.

I claim:

1. A shoe lace replacing and shoe fastening device comprising:

a pair of eyelet members, each of said members having a base plate with a plurality of spaced apertures therein having securing means therein for securing each of said base plates to at least a pair of adjacent spaced eyelets generally aligned with at least two of said apertures along each side of the upper of a shoe, each of said base plates having an upstanding peripheral wall with an inwardly extending flange along the upper surface thereof extending partway about the periphery of each base member forming a slotted opening on one side of each base member, the slotted openings in each of said base members opening outwardly from said shoe in opposite directions; and an insert member insertible into each slotted opening, one of said insert members having a U-shaped elongated flange on the upper surface thereof forming an opening between the underside of said flange and the upper surface of the base member on which said U-shaped flange is mounted, and the other of said insert members having an elongated strip secured thereto with readily detachable and attachable mating hook and loop portions of material at spaced locations along the upper surface thereof whereby said strip is insertible between said U-shaped flange and the upper surface of the base member to which said U-shaped flange is mounted and foldable about itself and about said U-shaped flange to engage said hook and loop portions.

2. In the device of claim 1 including indicia means on the side of said strip opposite the side thereof having said material thereon.

3. In the device of claim 1 wherein the thickness of each of said insert members is related to the spacing between the lowermost portion of the upper inwardly extending flange of each base member and the upper surface of said base member and the width of each of said insert members is related to the width of each slotted opening.

4. In the device of claim 1 wherein said insert members and said base members are generally elongated and rectangular, said slotted openings opening along one elongated side of each base member.

* * * * *